United States Patent [19]

Binder

[11] 4,246,588

[45] Jan. 20, 1981

[54] PARTICLE FEED ARRANGEMENT FOR APPLYING SOLID PARTICLES TO THE IMAGE CARRIER OF A NON-IMPACT PRINTER

[75] Inventor: Jean J. Binder, Valdoie, France

[73] Assignee: Compagnie Internationale pour l'Informatique, Paris, France

[21] Appl. No.: 952,081

[22] Filed: Oct. 17, 1978

[30] Foreign Application Priority Data

Oct. 24, 1977 [FR] France ..... 77 31966

[51] Int. Cl.[3] ..... G03G 19/00; G03G 15/08

[52] U.S. Cl. ..... 346/74.1; 118/654; 118/657

[58] Field of Search ..... 346/74.1, 153, 155; 358/301; 118/653-654, 657, 658; 355/300

[56] References Cited

U.S. PATENT DOCUMENTS

| | | | |
|---|---|---|---|
| 3,552,355 | 1/1971 | Flint | 118/657 X |
| 4,122,209 | 10/1978 | Kinard | 118/657 X |
| 4,149,486 | 4/1979 | Hardenbrook | 118/653 |

*Primary Examiner*—John H. Wolff

*Attorney, Agent, or Firm*—Kerkam, Stowell, Kondracki & Clarke

[57] ABSTRACT

A particle feed arrangement for applying solid particles contained in a particle storage tank to an image carrier of a non-impact printer. The arrangement includes a conveying member disposed to pass within a particle supply source to feed the particles to the vicinity of a surface of the carrier. A deflector is interposed between the carrier and the conveying member to collect the particles conveyed by the member. The deflector has one of its edges arranged in the immediate vicinity of the said carrier to form, in conjunction with the carrier, a trough of generally prismatic shape in which the particles so collected accumulate. The other edge of the deflector, which is formed by a rectangular plate, is virtually in contact with the surface of a particle conveying member to cause the particles to be collected in the trough. The carrier is movable in a direction in which it carries the particles towards the edge of the said prism which is spaced from the surface of the carrier to allow the particles which are carried past this edge to remain applied only to the sensitized zones of the said image carrier and excess unapplied particles to be returned to the supply source.

14 Claims, 4 Drawing Figures

PARTICLE FEED ARRANGEMENT FOR APPLYING SOLID PARTICLES TO THE IMAGE CARRIER OF A NON-IMPACT PRINTER

BACKGROUND OF THE INVENTION

1. Field of the Invention

The present invention relates to an arrangement for applying solid particles to the image carrier of a non-impact printer.

2. Description of the Prior Art

In present day equipment which is used for data processing, greater and greater use is being made of high-speed printers in which characters are printed without relying on raised printing characters impacting on a recipient sheet of paper. Such printing machines, termed non-impact or strike-less transfer printing machines, generally have an image carrier which is usually formed by a rotary drum or an endless belt. The surface of the carrier is formed with sensitized zones or latent images, by electrostatic or magnetic methods. These zones correspond to the characters to be printed and are capable of attracting solid particles of pigment. This carrier is then brought into contact with a recipient sheet of paper to enable the solid particles held by the sensitized zones of the carrier to be transferred to the sheet so that they can be permanently affixed to it.

In the prior art, various particle applicator arrangements have been used to apply solid particles of pigment to the image carrier of a printing machine of this kind. For example, in the application of a powdered pigment to an image carrier formed by an endless belt, use has been made of an arrangement incorporating two pressure rollers between which the endless belt passes. One of the rollers is in contact with pigment contained in a tank to allow the solid particles of pigment to be picked up by this roller as it rotates and deposited on the belt. Such an arrangement has the drawback, however, that it does not always provide an adequate supply of pigment to the belt. Thus, there is a danger that certain sensitized zones of the belt will be devoid of pigment after passing between the pressure rollers.

To ensure an adequate supply of pigment to the image carrier, use has been made of a feed arrangement which incorporates a casing containing the powdered pigment. This casing is provided with an opening across which the image carrier passes. The carrier is supplied with pigment by a cylindrical brush which, rotates within the casing and throws the particles of pigment onto the surface of the carrier as the latter passes across the opening. This arrangement is also not entirely satisfactory in use owing, on the one hand, to the fact that it causes a cloud of pigment particles to be formed which spreads outside the casing, and is particularly unpleasant for people who, being near the printer, come into contact with this cloud, and, on the other hand, to the fact that the particles develop an electrostatic charge and, being thrown onto the carrier, are able to cling to unsensitized zones of the carrier as a result of electrostatic attraction.

In cases where the image carrier of the printer is a magnetic image carrier, use has also been made of pigment supply arrangements formed by a hollow cylinder within which are arranged one or more magnetic cores. This cylinder is positioned close to the image carrier and the pigment, which is composed of a material having magnetic properties, is attracted to the surface of the cylinder by the magnetic field set up by the cores. When the cylinder rotates, the particles of pigment so attracted by the cylinder are carried round with it and, when they come close to the image carrier, are attracted and thereby applied to the magnetized zones of the carrier. The principal drawback of a supply arrangement of this nature is that the image carrier, which passes very close to the hollow cylinder, is inevitably subject to the effect of the magnetic flux generated by the cores which are situated inside the cylinder, so that there is a danger of the information carried by the carrier being severely disrupted. This danger can be reduced by moving the cylinder further away from the carrier, but the distance between the cylinder and the carrier can not exceed a certain limiting value beyond which it is impossible for the carrier to pick up the particles of pigment. As a result, the distance which separates the cylinder from the carrier has to be adjusted with very great accuracy if all the above-mentioned requirements are to be met.

SUMMARY OF THE INVENTION

The present invention overcomes all these disadvantages and proposes a relatively simple and inexpensive arrangement which allows solid particles to be applied to the image carrier of a non-impact printer in an effective fashion. This arrangement is all the more advantageous in that it can be used both for printers of the electrostatic type and for magnetic printers.

The invention in its preferred embodiment includes an arrangement for applying solid particles contained in a tank in the image carrier of a non-impact printer. A conveying member is arranged to feed the particles into the vicinity of the surface of the carrier. A deflector is interposed between the carrier and the conveying member to collect the particles conveyed by this member. The deflector has one of its edges arranged in the immediate vicinity of the carrier in such a way as to form in conjunction with the carrier, a trough of generally prismatic shape and more particularly a dihedral prism in which the collected particles build up. The image carrier is moved in a direction in which it carries the particles towards the edge of the prism, i.e. toward the build up of particles. The particles which are carried past this edge are applied only to the sensitized zones of the said image carrier and excess non-applied particles are returned to the tank.

BRIEF DESCRIPTION OF THE DRAWINGS

Other objects and advantages of the invention will become apparent from the following description, which is given by way of non-limiting example, and by reference to the accompanying drawings, in which.

DESCRIPTION OF THE PREFERRED EMBODIMENTS

Figure 1:
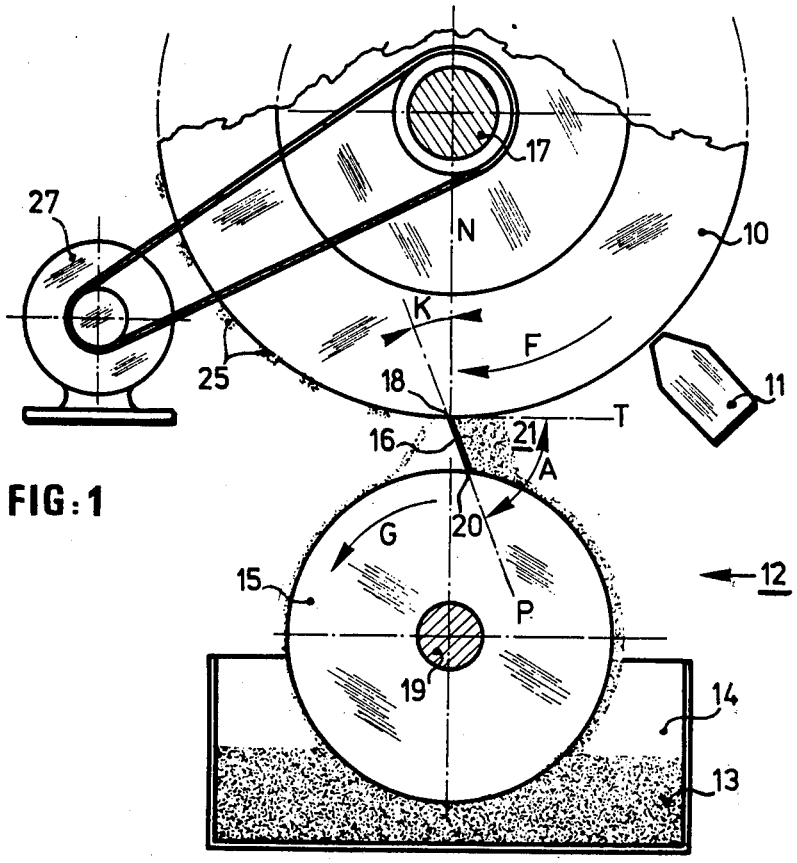
FIG. 1 is a general diagram of an arrangement embodying the invention which is used to apply a powdered pigment to the image carrier of a magnetic printer.

The printing machine, of which part is shown schematically in FIG. 1, includes an image carrier which is formed, in this embodiment, by a magnetic drum 10 rotated by an electric motor 27. To this end, drum shaft 17 has mounted at one end thereof a pulley 9 drivingly connected by belt 8 to a pulley mounted on the motor drive shafts. Of course, any other suitable driving arrangement may be provided.

Information is recorded on drum 10 by a magnetic recording member 11 which is arranged, as shown in FIG. 1, near the outer surface of the drum. In the embodiment illustrated in FIG. 1, recording member 11 is formed by an assembly consisting of a plurality of magnetic recording heads, which are positioned side-by-side and aligned in a direction parallel to the axis of rotation of the shaft 17 on which the drum 10 rotates. Only one head is shown illustratively in end view to simplify the drawings. Each of the heads may be energized at various times by an electric current to generate a varying magnetic field, the effect of which is to create magnetized zones on the surface of the drum as it passes in front of the recording members 11. The times at which the heads are energized are determined, in a known fashion, in such a way as to obtain, on the surface of the drum, magnetized zones whose shapes correspond to those of the characters to be printed. The magnetized zones on the drum then pass as the drum rotates in front of an applicator arrangement generally indicated at 12 which is situated below the drum 10, and which enables particles of a powdered pigment 13 contained in a tank 14 to be transferred from the tank and applied to the surface of the drum.

In the embodiment shown in FIG. 1, the pigment is advantageously composed of magnetic particles coated with a resin which, when heated, melts and attaches itself to the paper on which it has been deposited. It should, however, be noted that various forms of pigment may be utilized and that the nature of the pigment is not a limitation of the invention. In the case of an electro-static printer, the pigment could very well be formed by a powder of the type well known in the art and not containing any magnetic particles. Powders of this nature have been described, in particular, in French Pat. Nos. 2,180,916 and 2,219,448.

As can be seen in FIG. 1, the applicator arrangement 12 includes a conveying member 15 in the form of a rotary drum mounted on shaft 19 and a fixed deflector 16. Drum 15 picks up the particles of pigment situated in the tank 14 as it is rotated counterclockwise, as shown by the direction of arrow G, and brings them into the vicinity of the surface of the drum 10. Fixed deflector 16 is positioned between the conveying drum member 15 and the carrier drum 10 to collect the particles conveyed by member 15 and to apply them to the surface of the drum 10. In the embodiment illustrated in FIG. 1, the conveying drum member is formed by a magnetic cylinder of a known kind, for example, such as that described and illustrated in U.S. Pat. No. 3,553,464. The conveying member could, however, be of a form different from that shown in FIG. 1, and could, for example, comprise a conveyor belt, a chain of moving permanent magnets, or a feed screw as shown, for example, in copending application Ser. No. 952,080, assigned to the assignee of the present invention.

The deflector 16 which is associated with the magnetic cylinder comprising the conveying member 15 is formed by a rectangular plate which is so orientated that its longitudinal edges are parallel to the axis of rotation 17 of the drum 10. Rectangular plate 16 is inclined to the surface of the drum along an imaginary plate P. As shown in FIG. 1, the intersection between the plane P of the plate and the surface of the drum extends along a line 18 which is parallel to the axis of the shaft 17 of the drum and which, in the plane of FIG. 1, i.e., in end view, is represented by a point. Stated another way, line 18 is formed by the intersection of the plane P of the plate 16 formed with a plane T tangential to the surface of the drum. Planes P and T intersect at an angle A of between 45° and 90°. In other words, the plate 16 forms with a line N normal to the surface of the drum at the point of intersection of this surface with the plane of the plate, an angle K of between 0° and 45°. In the preferred embodiment, angle A is approximately 80° and consequently angle K is approximately 10°.

FIG. 1 also shows that the rotatable shaft 19 of conveying member or magnetic cylinder 15 is mounted parallel to rotatable shaft 17 of the drum 10 which has suitable drive means to effect rotation thereof. The cylinder 15 is arranged in such a way that its surface is virtually in contact with the longitudinal edge 20 of the plate 16, i.e. the lower edge as shown in the drawing. Under these conditions, when the cylinder 15 turns in the direction indicated by arrow G in FIG. 1, the particles of pigment 13 which are picked up by the cylinder are arrested when they reach the plate 16 and then build up in the trough 21 formed by the space between the plate 16 and the drum 10. To retain the particles which accumulate in this trough 21, lateral plates may be provided on either side or end of plate 16. One of such plates is indicated at 22 in FIG. 2. The other plate would, of course, be disposed at the other end of plate 16. As can be seen in FIG. 1, the trough 21, which is bounded on the one hand by plate 16 and on the other hand by drum 10, is virtually in the shape of a prism, having an edge or apex formed at the line 18 mentioned above.

It should also be noted that the direction of rotation of the magnetic drum, which is indicated by arrow F in FIG. 1, is such that the particles in the trough 21 which are applied to the magnetized zones of the drum are carried by the drum towards the edge 18 of the trough 21. However, the particles which are carried along in this way are not arrested as they pass the plate 16, due to the fact that, as can be seen by referring to the detail view shown in FIG. 2, the plate 16 is spaced slightly from drum 10 and does not touch the surface of the drum 10. The opening D between longitudinal edge 23 of plate 16 and the drum 10, is of a width which is sufficient to allow the particles of pigment which are carried along by the drum 10 to leave the trough 21. After leaving the trough 21, these particles of pigment continue to adhere to the magnetized zones of the drum 10 and form clusters of particles such as those shown at 25 in FIG. 1. Excess particles not adhering to the sensitized portions are carried past edge 21 and fall onto the surface of conveying drum 15 and returned to the supply of pigment particles within tank 14.

It should be mentioned that the distance D between the longitudinal edge 23 and the surface of the drum 10 is set in such a way as to lie between two limiting values, namely, a lower limiting value below which the magnetized zones of the drum 10 which have passed across the trough 21 are not sufficiently well covered with pigment, and an upper limiting value above which an excessive amount of pigment particles escape through the opening 24 and thus create an undesirable flood of particles. It has been found that, for the type of pigment used in the applicator arrangement now being described, these lower and upper limiting values are 3/10ths of a millimeter and 1 millimeter respectively.

Figure 2:
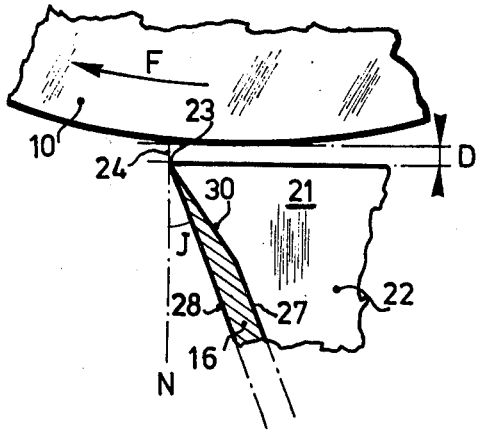
FIG. 2 shows a detail of the arrangement of FIG. 1.
Figure 3:
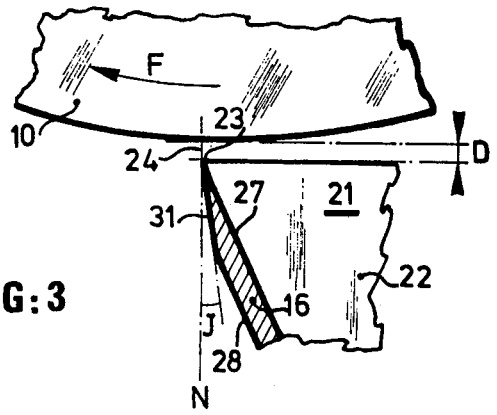
FIG. 3 shows a modified version of the detail shown in FIG. 2.
Figure 4:
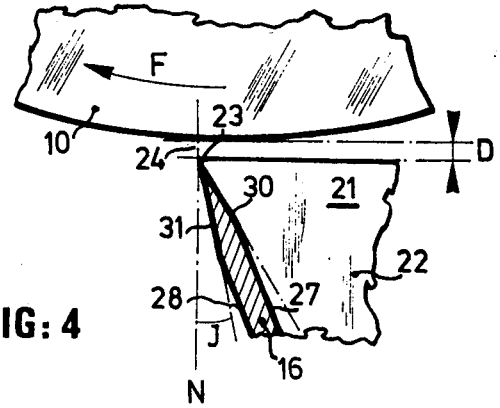
FIG. 4 shows another modified version of the detail shown in FIG. 2.

As can be seen by referring to FIGS. 2, 3 and 4, the faces 27 and 28 of the plate 16, which are respectively situated inside and outside the trough 21, are machined in such a way that the longitudinal edge 23 is sharp, this edge being intended to prevent those particles which escape through the opening 24 of the trough and which are not attracted by the magnetized zones of the drum from collecting, even temporarily, on this edge. Under these conditions, these particles fall back onto the magnetic cylinder 15 as a fine rain of particles, as can be seen in FIG. 1.

Referring again to FIGS. 2, 3 and 4, it can be seen that this sharp edge 23 is obtained by forming a bevel either solely on the inner face 27 of the plate 16 as can be seen at 30 in FIG. 2, solely on the outer face 28 of the plate as can be seen at 31 in FIG. 3, or alternatively on both faces 27 and 28 of the plate as shown in FIG. 4. It should be noted that a line N normal to the surface of the drum 10 and which passes through this edge 23 forms with the unbevelled face 28 of the plate 16 (the case shown in FIG. 2) or with the bevelled part 31 of this face (the case shown in FIGS. 3 and 4), an angle J of between zero and 15, this angle being intended to assist those particles which escape through the opening 24 of the trough, and are not attracted by the drum 10, to drop down again in the tank with a mimimum of build-up of particles on the back surface.

It should also be noted that in the embodiment described where the particles of pigment are formed of a material which is capable of being attracted by a magnet, the trough materials such as plate 16 and sides 22 are made of a non-magnetic material, such as copper, which prevents the particles escaping through the opening 24 of the trough from being attracted by the plate 16 or sides 22 and thus sticking thereto.

Owing to the fact that the width D of the opening 24 is very small, equalling a millimeter at the most, the amount of pigment which emerges through the opening is relatively small. This being the case, the speed of movement of the conveying member, that is to say the magnetic drum 15 in the present case, is very slow, this speed being set by known means in such a way that the amount of pigment which is fed into the trough 21 by this member in a given period of time is equal to, or slightly greater than, the amount of pigment which leaves through the opening 24 in the same period.

The foregoing description is given by way of example and should not be construed to limit or restrict it in anyway to the embodiments described and illustrated. Resort should be made to the following claims to the invention which are intended to cover all technical equivalents of the invention as described and illustrated, when considered separately or in combination and which come within the true spirit and full scope of the invention.

I claim:

1. Apparatus for developing a latent image formed on the surface of an image carrier arranged for movement in a predetermined path, comprising:

a tank for containing a supply of attractable solid particles;

conveying means adapted for movement in a path past said supply of particles to cause said particles to be fed to the vicinity of a lowermost postion in the path of said image carrier;

a deflector interposed between said conveying means and said image carrier at said lowermost position, said deflector having two opposite parallel edges, one of said edges being disposed in close proximity to the surface of said image carrier to to preclude a fluidized standing wave of particles from forming and to form, in conjunction with said surface, a trough of generally prismatic shape in which are accumulated said particles arrested by said last mentioned edge, the other of said edges being in contact with said conveying means to cause particles conveyed by said means to be collected and accumulated in said trough, a driving means for moving said image carrier in a direction in which it carries accumulated particles towards said deflector edge in close proximity to the surface of said carrier, the distance between said deflector edge and said surface being greater than a first limiting value in order to allow particles which are carried by said image carrier not to be arrested by said deflector and smaller than a second limiting value in order to prevent the formation of a wave of particles.

2. Apparatus for developing a latent image according to claim 1, wherein the deflector comprises a plate inclined relative to the surface of the image carrier and disposed with respect to said surface to provide between itself and the carrier, an opening for the passage of the particles, the width of this opening being between 3/10th of a millimeter and 1 millimeter.

3. Apparatus for developing a latent image according to claim 2, wherein with a line normal to the surface of the carrier at the intersection of this surface with the plane of the plate, the plate forms an angle of between 0° and 45°.

4. Apparatus for developing a latent image according to claim 2 or 3, wherein the said edge of the deflector plate which is situated in the immediate vicinity of the carrier includes a sharp edge such that particles which leave the trough through the opening and which are not attracted by the sensitized zones of the image carrier are prevented from collecting on said edge.

5. Apparatus for developing a latent image according to claim 4, wherein said plate includes a bevel on at least one of two opposed faces of the plate to form said sharp edge.

6. Apparatus for developing a latent image according to claim 5, wherein the bevel on the face of the plate is on the outside of the trough, said bevel forming, with a line normal to the surface of the image carrier and which passes through said sharp edge, an angle of between 0° and 15°.

7. Apparatus for developing a latent image according to claim 5, wherein said bevel is only on that face of the plate which is on the outside of the trough, the face of the plate which is on the outside of the the trough forming with a line normal to the surface of the image carrier whch passes through this sharp edge, an angle of between 0° and 15°.

8. Apparatus for developing a latent image according to claim 5 wherein the solid particles are of a material which is capable of being attracted by a magnet and said deflector is of non-magnetic material.

9. Apparatus for developing a latent image according to any of claims 2 or 3 wherein the solid particles are of a material which is capable of being attracted by a magnet, and said deflector is of non-magnetic material.

10. Apparatus for developing a latent image formed on the surface of a drum rotatable about its axis, said apparatus comprising:

a tank for containing a supply of attractable solid particles, said tank being disposed beneath said drum, conveying means comprising a feed roll mounted on an axis disposed in parallel direction to the axis of said drum, said feed roll being positioned to come into contact with particles in said tank and convey them to the vicinity of the surface of said drum, a deflector interposed between said drum and said feed roll and having two opposite parallel edges, one of said edges being disposed in close proximity to the surface of said drum to form, in conjunction with said surface, a trough of generally prismatic shape, the other of said edges being in contact with said roll to cause particles conveyed by said roll to be collected and accumulated in said trough; and driving means for rotating said drum in a direction in which it carries particles so accumulated towards said deflector edge in close proximity to the surface of said drum, the distance between said deflector edge and said drum being greater than a first limiting value in order to allow particles which are carried by said drum not to be arrested by said deflector and smaller than a second limiting value in order to prevent the formation a wave of particles.

11. Apparatus for developing a latent image according to claim 10 wherein the deflector comprises a plate inclined relative to the surface of the image carrier and disposed with respect to said surface to provide, between itself and the carrier, an opening for the passage of the particles, the width of this opening being between 3/10ths of a millimeter to 1 millimeter.

12. Apparatus for developing a latent image according to claim 11, wherein with a line normal to the surface of the carrier at the intersection of this surface with the plane of the plate, the plate forms an angle of between 0° and 45°.

13. Apparatus for developing a latent image according to claim 11 or 12, wherein the said edge of the deflector plate which is situated in the immediate vicinity of the carrier includes a sharp edge such that particles which leave the trough through the opening and which are not attracted by the sensitized zones of the image carrier are presented from collecting on said edge, said plate including a bevel on at least one of two opposed faces of the plate to form said sharp edge, the bevel on the face of the plate being on the outside of the trough and said bevel forming, with a line normal to the surface of the image carrier and which passes through said sharp edge, an angle of between 0° and 15°.

14. Apparatus for developing a latent image according to claim 13, wherein said bevel is only on that face of the plate which is on the inside of the trough, the face of the plate which is on the outside of the trough forming with a line normal to the surface of the image carrier which passes through this sharp edge, an angle of between 0° and 15°.

* * * * *

UNITED STATES PATENT AND TRADEMARK OFFICE

CERTIFICATE OF CORRECTION

PATENT NO. : 4,246,588

DATED : January 20, 1981

INVENTOR(S) : Jean Jacques Binder

It is certified that error appears in the above—identified patent and that said Letters Patent is hereby corrected as shown below:

(73) "Compagnie Internationale pour l'Informatique" should be -- Compagnie Internationale pour l'Informatique Cii-Honeywell Bull (Societe Anonyme) --.

Claim 1 (col. 6) line 5, "to to" should be -- to --;

Claim 7, line 4, "the the" should be -- the --;

Claim 10 (Col. 7) line 19: After "trough;" insert -- and --;

Claim 10, last complete line, after "formation" insert -- of --,

Claim 13, line 17, "presented" should be -- prevented --;

Signed and Sealed this

*Twenty-eighth* Day of *April 1981*

[SEAL]

*Attest:*

RENE D. TEGTMEYER

*Attesting Officer*

*Acting Commissioner of Patents and Trademarks*